US005915904A

United States Patent [19]

Hefty

[11] Patent Number: 5,915,904

[45] Date of Patent: Jun. 29, 1999

[54] BINDING DEVICE

[76] Inventor: John B. Hefty, 1232 Paula Cir., Gulf Breeze, Fla. 32561

[21] Appl. No.: 08/916,730

[22] Filed: Aug. 18, 1997

Related U.S. Application Data

[63] Continuation-in-part of application No. 08/502,386, Jul. 14, 1995, Pat. No. 5,692,866.

[51] Int. Cl.[6] ..... B42B 5/06

[52] U.S. Cl. ..... 412/34; 412/9

[58] Field of Search ..... 412/9, 33, 34, 412/38, 39; 402/8, 14; 281/21.1

[56] References Cited

U.S. PATENT DOCUMENTS 3,479,676 11/1969 Morris ..... 412/34

4,986,713 1/1991 Zoltner et al. ..... 412/34

5,364,216 11/1994 Mondel ..... 412/34

*Primary Examiner*—Willmon Fridie, Jr.

*Attorney, Agent, or Firm*—George A. Bode; Bode & Associates; Lisa D. Charouel

[57] ABSTRACT

A binding device for crimping or deforming a U-shaped channel around a plurality of sheets of paper comprises a stationary crimping bar and a rotatable crimping bar rotatable coupled above the stationary crimping bar. The rotatable crimping bar has coupled thereto a first weight member fixedly coupled in the center thereof wherein the first weight serves to provided a centralized force of gravitational pull to urge the rotatable crimping bar toward a crimping position. The stationary crimping bar has coupled thereto a second weight member fixedly coupled in the center thereof wherein the second weight member provides a centralized force of gravitational pull for stability.

20 Claims, 4 Drawing Sheets

FIG. 4
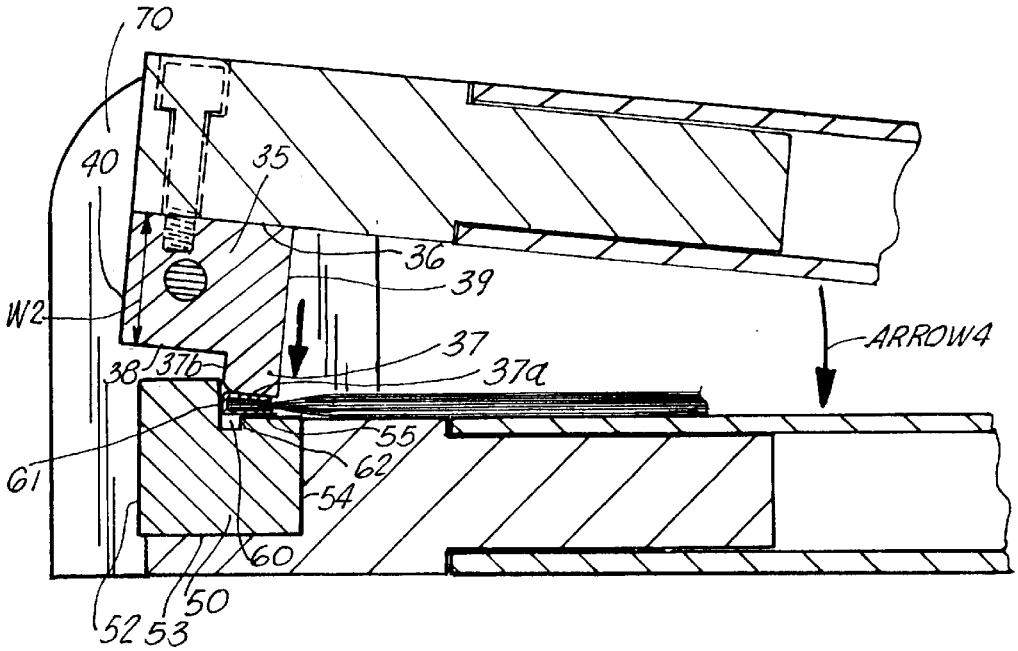
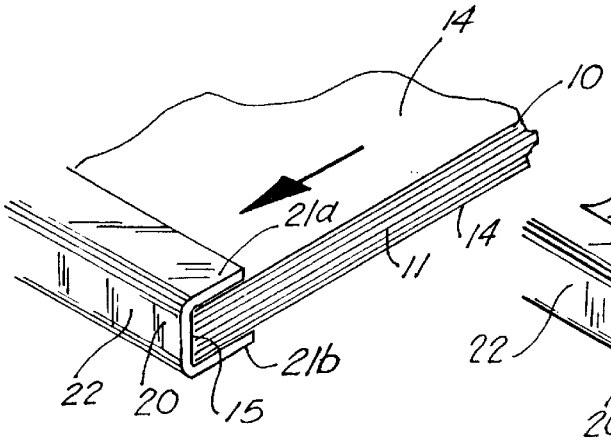
FIG. 5
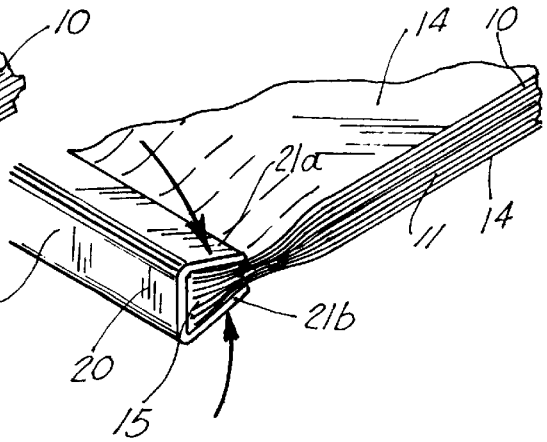
FIG. 6

BINDING DEVICE

This application is a continuation-in-part application of a previous application by the same inventor bearing U.S. Ser. No. 08/502,386 filed Jul. 14, 1995 now U.S. Pat. No. 5,692,866. The entirety of this previous application is incorporated herein by reference as if set forth in full below.

BACKGROUND OF THE INVENTION

Field of the Invention

The present invention relates to a binding device and, more particularly, to a new safety binding device for mechanically binding a stack of loose, or otherwise, sheets of paper to permanently secure such sheets of paper together, in a book-like manner, using a deformable U-shaped clamping means. The mechanical operation of my new safety binding device is extremely simplified with the use of a rotatable crimping bar having a weight centrally coupled thereto wherein such weight serves to 1) couple a handle member to said rotatable crimping bar wherein such handle member moves said rotatable crimping bar between a crimping position and a non-crimping position, easily and effortlessly; 2) provide a centralized force of gravitational pull to urge said rotational crimping bar toward said crimping position or said non-crimping position; and, 3) stop the rotation of said rotatable crimping bar when said rotatable crimping bar is rotated into its non-crimping position.

General Background

Mechanically binding a stack of loose, or otherwise, sheets of paper to permanently secure such sheets of paper together, in a book-like manner, using a deformable U-shaped clamping means is well known. Examples of such are described in, U.S. Pat. No. 4,141,100, by Domroe et al.; U.S. Pat. No. 4,986,713, by Zoltner et al.; U.S. Pat. No. 5,061,139, by Zoltner; and, U.S. Pat. No. 5,066,182, by Stonebraker et al. Mechanically binding a stack of sheets of paper to permanently secure such sheets of paper together has become extremely important for some types of book-binding processes. Moreover, mechanical binding using a U-shaped channel is also applicable for permanently securing a plurality of sheets of paper (other than for a book), fabric or the like. The invention, by Domroe et al., applies heat to a plastic U-shaped channel for crimping the U-shaped channel such that the sheets of paper may be secured together. In order to generate such heat, an electrical system for generating heat must be used in the crimping process, thereby increasing the complexity of the binding device. Furthermore, the heating elements may deliver variable amounts of heat for deforming the U-shaped channel which has on occasion compromised the secure hold of the U-shaped channel. Moreover, the use of heat can be hazardous to the operator of the device.

The invention, by Zoltner et al., applies a force of pressure to both sides of a metal U-shaped channel for crimping such metal U-shaped channel. The binding device, by Zoltner et al., has a complex mechanical design for sliding a moveable jaw toward a fixed jaw in response to the pivotal rotation of a handle member.

Other patents present in the art are U.S. Pat. No. 3,284,102, by Sack; U.S. Pat. No. 3,749,423, by Abildgaard et al.; U.S. Pat. No. 4,091,487, by Axelrod; U.S. Pat. No. 4,139,216, by Saint Clair; and U.S. Pat. No. 4,706,994, by Lockhart; all of which are directed to binding sheets of paper, but do not meet the needs of the device of the present invention.

SUMMARY OF THE PRESENT INVENTION

The preferred embodiment of my new safety binding device of the present invention solves the aforementioned problems in a straight forward and simple manner. What is provided is a new safety binding device for mechanically binding a stack of loose, or otherwise, sheets of paper to permanently secure such sheets of paper together, in a book-like manner, using a deformable U-shaped clamping means. The mechanical operation of my new safety binding device is extremely simplified with the use of a rotatable crimping bar having a weight centrally coupled thereto wherein such weight serves to 1) couple a handle member to said rotatable crimping bar wherein such handle member moves said rotatable crimping bar between a crimping position and a non-crimping position, easily and effortlessly; 2) provide a centralized force of gravitational pull to urge said rotational crimping bar toward said crimping position or said non-crimping position; and, 3) stop the rotation of said rotatable crimping bar when said rotatable crimping bar is rotated into its non-crimping position.

The binding device for crimping or deforming a U-shaped clamping means around a plurality of sheets of paper comprises a stationary crimping bar and a rotatable crimping bar rotatable coupled above the stationary crimping bar. The rotatable crimping bar has coupled thereto a first weight member fixedly coupled in the center thereof wherein the first weight serves to provided a centralized force of gravitational pull to urge the rotatable crimping bar toward a crimping position. The stationary crimping bar has coupled thereto a second weight member fixedly coupled in the center thereof wherein the second weight member provides a centralized force of gravitational pull for stability.

In view of the above, it is an object of the present invention to provide a safety binding device which utilizes the weight and/or power of an operator for applying a force of pressure to crimp a U-shaped clamping means.

Another object of the invention is to provide a safety binding device which allows mechanically binding of a stack of loose, or otherwise, sheets of paper while such sheets of paper are supported in the horizontal plane.

A further object of the invention is to provide a safety binding device that enables binding to occur without the need for heat to crimp a U-shaped channel.

It is a still further object of the present invention to provide a safety binding device which can be utilized by the individual artist or hobbyist to bind books or any collection of loose, or otherwise, sheets of paper without requiring a multitude of specialty equipment or a high level of skill.

It is a still further object of the present invention to provide such a safety binding device which minimizes the amount of and time required for each such binding.

It is a still further object of the present invention to provide a safety binding device whereby customized or specialty books may be bound in a quick and inexpensive manner and without fear of providing inadequate binding.

It is a still further object of the present invention to provide a safety binding device which utilizes a U-shaped clamping means wherein when such U-shaped clamping means is crimped, sheets of paper are securely held together such that they cannot come loose under normal use.

In view of the above objects, it is a feature of the present invention to provide a safety binding device which is simple to use and manufacture.

It is another feature of the present invention to provide a safety binding device which is not complex in mechanical design thereby eliminating mechanical components which are capable of malfunctioning.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 4 illustrates a cross-sectional view along the plane of 2—2 showing a closed state of the safety binding device of the present invention;

FIG. 5 illustrates the U-shaped clamping means un-crimped and a stack of loose, or otherwise, sheets of paper inserted therein; and, FIG. 6 illustrates the U-shaped clamping means crimped to secure together the inserted stack of loose, or otherwise, sheets of paper.

DETAILED DESCRIPTION OF THE PREFERRED EMBODIMENT

Figure 1:
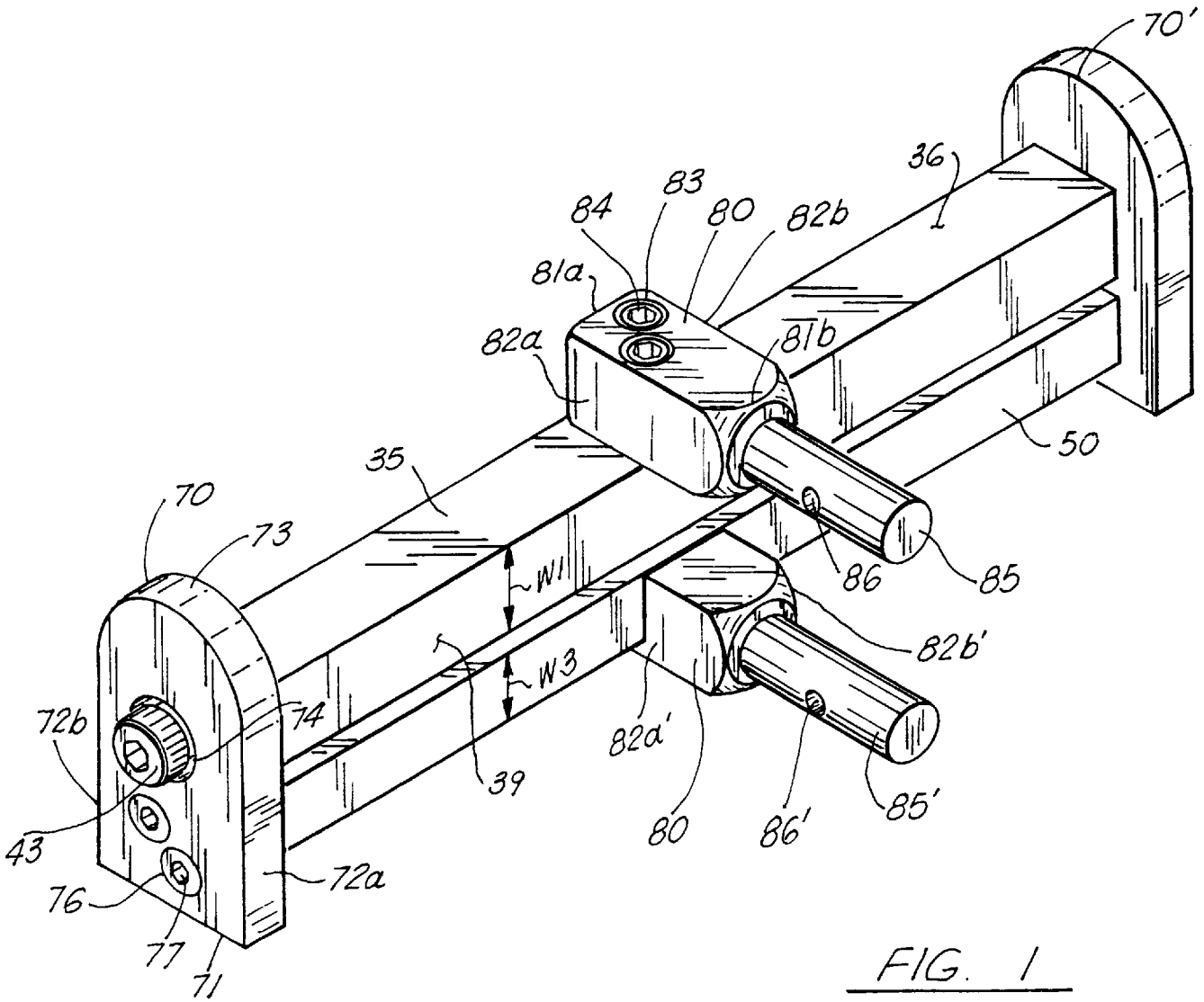
FIG. 1 illustrates a perspective view of the safety binding device of the present invention without the pivoting handle member and the stationary handle member.

Referring now to the drawing, and in particular FIG. 5, there is shown a collection or stack 11 (hereinafter referred to as stack 11) of loose, or otherwise, sheets of paper 10 which comprise the contents of written material such as, without limitation, a book or a document. Preferable, all loose sheets of paper 10 of stack 11 have all their edges flush. Additionally, end sheets or end pages 14 (hereinafter referred to as end sheets 14) would be placed on the top and bottom of stack 11. Ideally, the exposed or outer surface or side of each of end sheets 14 would contain a press-on adhesive (sticky-backing) that is temporarily covered by a protective coating such that upon removal of the coating, the adhesive is exposed. Thereafter, a hard or soft cover may be adhered thereto.

Stack 11 having all loose sheets of paper 10 aligned (such that their edges are perfectly flush) will then be inserted along its spine side or marginal edge 15 (hereinafter referred to as spine side 15) into clamping means 20. In the exemplary embodiment, clamping means 20 is generally a metal U-shaped channel that extends fully along spine side 15 of stack 11. Clamping means 20 is preferably made of a thin, lightweight metal, such as steel, so that it may be bent, deformed or crimped so as to securely hold permanently sheets of paper 10 of stack 11 together. Nevertheless, clamping means 20 may be constructed of other material so long as it may be deformed to securely holding sheets of paper 10 of stack 11 securely together. While the preferred embodiment provides for clamping means 20 being of the same length as spine side 15, clamping means 20 may be shorter or longer, as desired.

The channel size defined by U-shaped clamping means 20 varies in accordance with the number of pages to be cased. Various channel sizes are described in U.S. Pat. No. 5,061,139, by Zoltner, incorporated herein by reference, as if set forth below in full.

Figure 2:
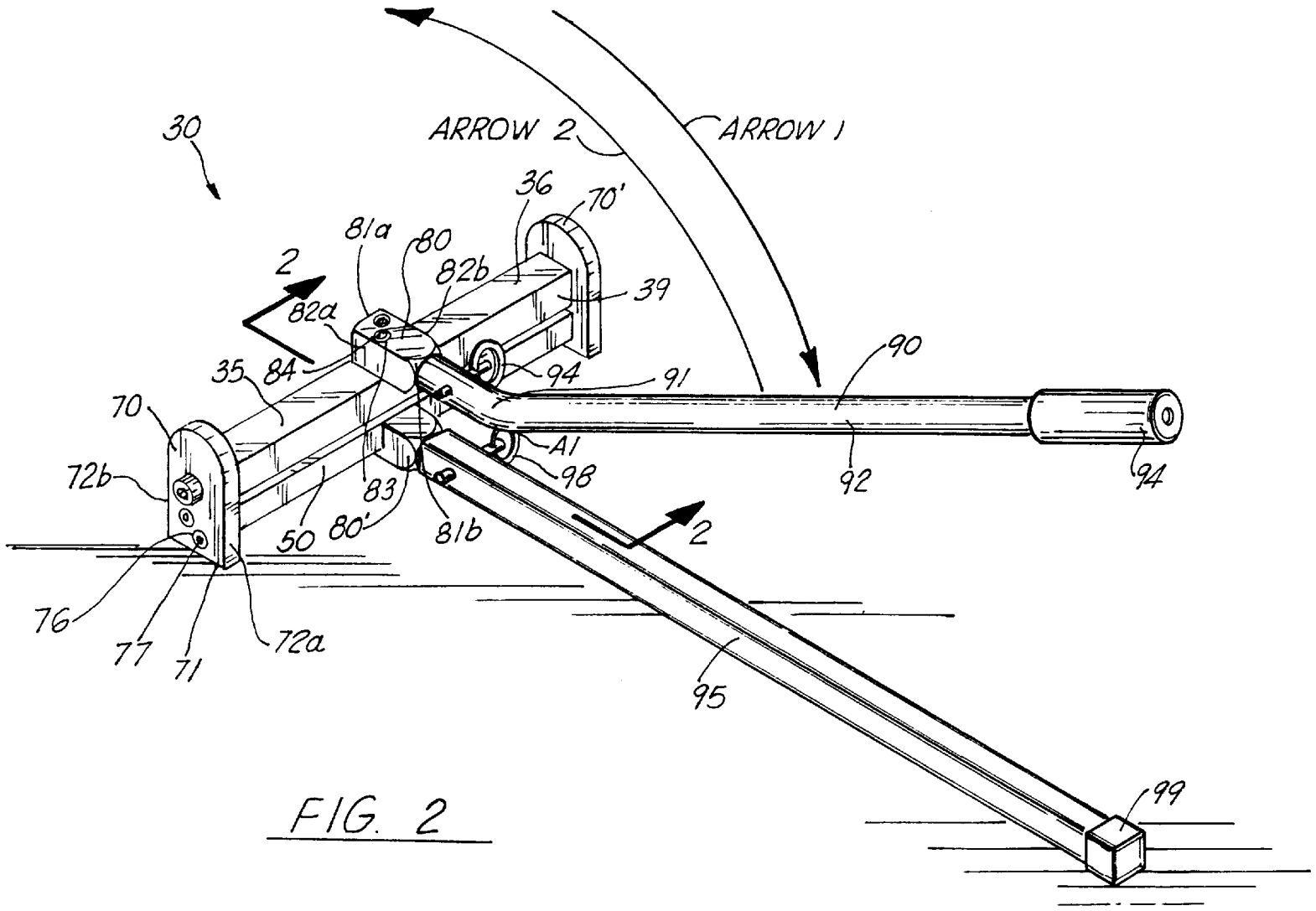
FIG. 2 illustrates a perspective view of the safety binding device of the preferred embodiment of the present invention.

Referring now to FIG. 2, the safety binding device of the present invention is designated generally by the numeral 30. Safety binding device 30 is generally comprised of rotatable crimping bar 35, stationary crimping bar 50, first and second support brackets 70 and 70', first and second weight members 80 and 80' and pivoting handle member 90 and stationary handle member 95.

Figure 3:
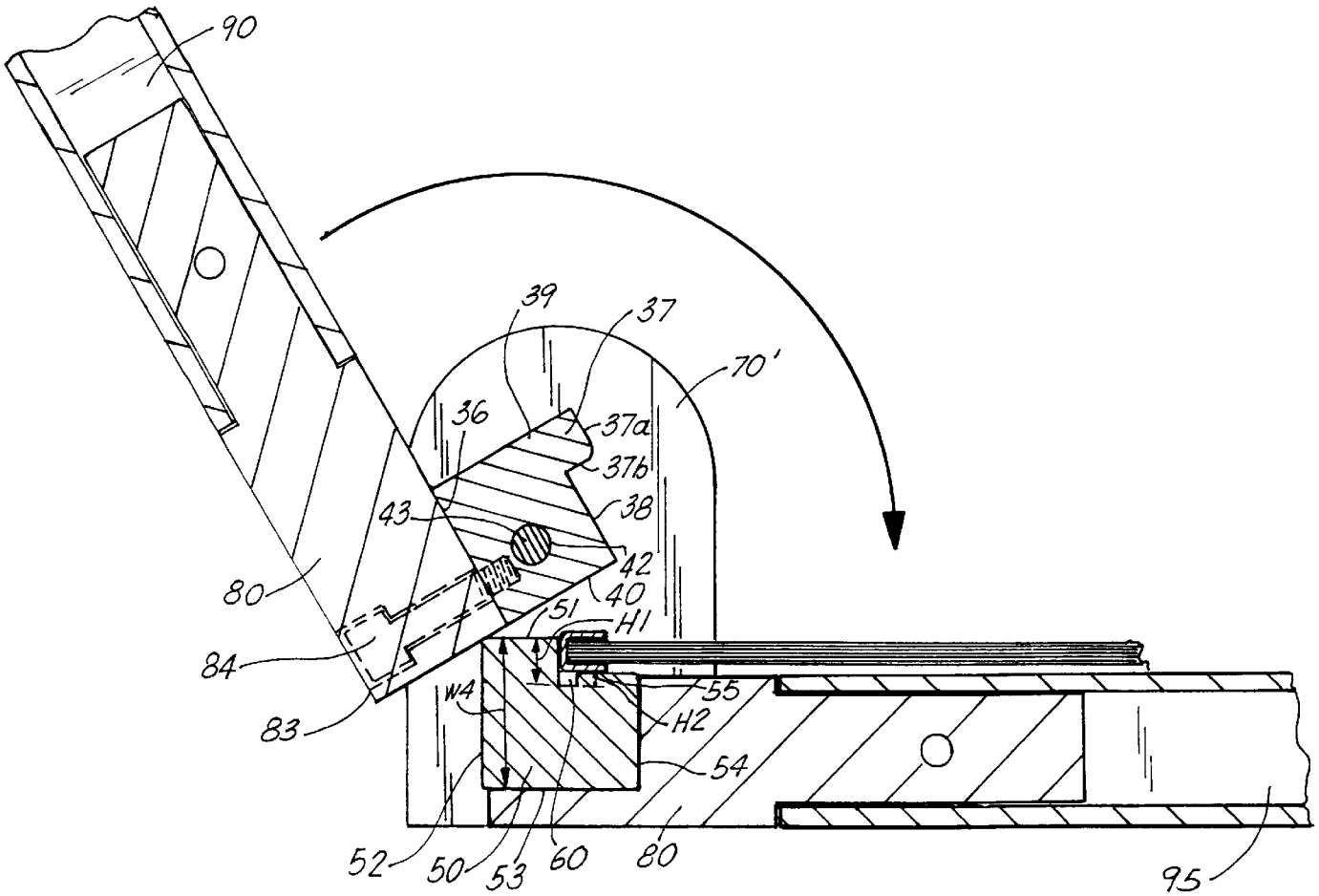
FIG. 3 illustrates a cross-sectional view along the plane of 2—2 showing an open state of the safety binding device of the present invention.

Referring also to FIGS. 1 and 3, rotatable crimping bar 35 is a rectangular shaped bar made of a heavy weight material wherein as rotatable crimping bar 35 is rotated in the direction of ARROW 1, the weight of rotatable crimping bar 35 allows it to easily fall forward to facilitate the crimping of clamping means 20.

Rotatable crimping bar 35 comprises top surface 36, bottom surface 38, front surface 39 and back surface 40. Front surface 39 has a width W1 which is greater than width W2 of back surface 40 thereby bottom surface 38 has formed therein rectangular projection 37 extending the length of rotatable crimping bar 35. Rectangular projection 37 comprises first surface 37*a* and second surface 37*b* wherein first surface 37*a* is perpendicular to front surface 39 and parallel to bottom surface 38 and second surface 37*b* is perpendicular to first surface 37*a* and bottom surface 38. Rectangular projection 37 serves to provide a continuous surface for engaging side 21*a* of U-shaped clamping means 20. Moreover, as a force of pressure is applied to force rotatable crimping bar 35 in the direction of ARROW 4, as best seen in FIG. 4, side 21*a* of U-shaped clamping means 20 is evenly deformed. Additionally, rectangular projection 37 serves to provide a continuous surface for facilitating the deformation of side 21*b* of U-shaped clamping means 20, as will be described below. While the preferred embodiment provides for a rectangular shaped projection, rectangular projection 37 may be any geometrical shape which will serve to provide a continuous surface that engages side 21*a* during the crimping process and facilitate the deformation of side 21*b*.

Rotatable crimping bar 35 has formed therein conduit 42 for receiving therein rotatable shaft member 43. Rotatable shaft member 43 extends the length of rotatable crimping bar 35 and projects outward from each distal end of rotatable crimping bar 35. Rotatable shaft member 43 does not rotate within conduit 42 but allows rotatable crimping bar 35 to rotate about its axis.

Stationary crimping bar 50 is a rectangular shaped bar made of the heavy weight material, as well. Stationary crimping bar 50 comprises top surface 51, back surface 52, bottom surface 53 and front surface 54. Front surface 54 has a width W3 which is less than width W4 of back surface 52, thereby ledge 55 is formed. Ledge 55 is perpendicular to front surface 54 and provides a support surface for side 21*b* of U-shaped clamping means 20.

Stationary crimping bar 50 has formed therein channel 60 extending the length thereof wherein channel 60 is defined by first wall 61 having a first height H1 and second wall 62 having a second height H2. First height H1 of first wall 61 provides a stop means for stopping back wall 22 of U-shaped clamping means 20.

First and second support brackets 70 and 70' serve to support rotatable crimping bar 35 and stationary crimping bar 50 in parallel alignment. Referring to FIG. 4, rotatable crimping bar 35, having rectangular projection 37, is positioned above stationary crimping bar 50 such that as rotatable crimping bar 35 is rotated in the direction of ARROW 4, first surface 37*a* becomes angled in relation to ledge 55 and the curved corner defined by the intersection of first surface 37*a* and second surface 37*b* pivots about the top corner edge defined by first wall 61 and top surface 51. Moreover, such curved corner prevents any significant deformity to back wall 22 of U-shaped clamping means. Therefore, the corner defined by front surface 54 and first surface 37*a* may be urged as far down as possible in relation to the height of stack 11. The angling of rectangular projection 37, a continuous surface, serves to deform side 21*a* of U-shaped clamping means 20 such that side 21*a* is sloped, as best seen in FIG. 6. Additionally, rectangular projection 37 serves to provide a continuous surface for facilitating the sloping of side 21*b* of U-shaped clamping means 20, as side 21*b* is deformed against ledge 55 and channel 60.

Since first and second support brackets 70 and 70' are identical, only one such support bracket will be described in detail. First support bracket 70 is a solid member defined by base surface 71, first and second parallel side surfaces 72*a* and 72*b* and arched-shaped surface 73. While the exemplary embodiment provides for arched-shaped surface 73, surface 73 may be flat or any other desired contour. First support bracket 70 comprises shaft aperture 74 for receiving therethrough a portion of rotatable shaft member 43 wherein rotatable shaft member 43 pivotally rotates in shaft aperture 74. Since rotatable crimping bar 35 is in parallel alignment with stationary crimping bar 50, shaft aperture 74 is located in the upper portion of first support bracket 70.

First support bracket 70 further comprises at least one aperture 76 for receiving therein at least one securing means 77 wherein the at least one securing means 77 serve to securely affix perpendicularly stationary crimping bar 50 to first support bracket 70, a distance above base surface 71.

First weight member 80 is a substantially rectangular member, preferably having beveled corners, and is made of a heavy weight material. First weight member 80 is defined by first and second short sides 81*a* and 81*b* and first and second long sides 82*a* and 82*b*. In the exemplary embodiment, the height of first weight member 80 does not extend beyond apex 73*a* of arched-shaped surface 73 of first support bracket 70. First weight member 80 comprises at least one aperture 83 for receiving therein at least one securing means 84 wherein the at least one securing means 84 serve to securely affix first weight member 80 to rotatable crimping bar 35.

First short side 81*a* is positioned flush with back wall 36 of rotatable crimping bar 35 wherein as rotatable crimping bar 35 is rotated to its non-crimping position in the direction of ARROW 2, shown in FIG. 2, first short side 81*a* serves to stop such rotation and maintain rotatable crimping bar 35 in such non-crimping position, shown in FIG. 3. First and second long sides 82*a* and 82*b* are positioned perpendicular to rotatable crimping bar 35 wherein a portion of first and second long sides 82*a* and 82*b* extend beyond front surface 39 thereby such portion provides a centralized force of gravitational pull toward said crimping position when rotatable crimping bar 35 is rotated in the direction of ARROW 3, of FIG. 3 or ARROW 1 of FIG. 2 or said non-crimping position when rotatable crimping bar 34 is rotated in the direction of ARROW 2 of FIG. 2.

First weight member 80 further comprises connector shaft 85 projecting from second short side 81*b*, wherein the axis of connector shaft 85 is parallel to first and second long sides 82*a* and 82*b*. Connector shaft 85 is made of a heavy weight material and serves to add to the centralized force of gravitational pull toward said crimping position or said non-crimping position. Moreover, connector shaft 85 has formed therethrough aperture 86 wherein aperture 86 is perpendicular to the axis of connector shaft 85.

As can be appreciated, the mechanical operation of my new safety binding device 30 is extremely simplified with the use of rotatable crimping bar 35 having first weight member 80 centrally coupled thereto wherein first weight member 80 serves to 1) couple pivoting handle member 90 to rotatable crimping bar 35 wherein pivoting handle member 90 moves rotatable crimping bar 35 between a crimping position and a non-crimping position, easily and effortlessly; 2) provide a centralized force of gravitational pull to urge rotational crimping bar 35 toward said crimping position or said non-crimping position; and, 3) stop the rotation of rotatable crimping bar 35 when rotatable crimping bar 35 is rotated into its non-crimping position.

Second weight member 80' differs from first weight member 80 only in that a portion of such weight is removed to form a L-shaped groove. Such L-shaped groove is defined by first surface 87 parallel to the plane of bottom surface 53 and second surface 88 parallel to the plane of front surface 54. Like first weight member 80, second weight member 80' comprises at least one aperture (not shown) for receiving therein at least one securing means (not shown) wherein the at least one securing means 82 serves to securely affix second weight member 80' to stationary crimping bar 50 in said L-shaped groove. The portion of second weight member 80' parallel to the plane of bottom surface 53 of stationary crimping bar 50 is flush with base surface 71. From the forgoing, said portion of second weight member 80' provides a central support surface between first and second support brackets 70 and 70' to prevent warping or bending of stationary crimping bar 50 when U-shaped clamping means 20 is crimped.

First short side 81*a'* is positioned substantially flush with back wall 52 of stationary crimping bar 50. First and second long sides 82*a'* and 82*b'* are positioned perpendicular to stationary crimping bar 50 wherein a portion of first and second long sides 82*a'* and 82*b'* extend beyond front surface 54, thereby such extended portion provides a centralized force of gravitational pull toward a support surface safety binding device 30 is placed on when binding collection or stack 11 of loose, or otherwise, sheets of paper 10. As a result, the base of safety binding device 30 is stabilized.

Like first weight member 80, second weight member 80' further comprises connector shaft 85' projecting from second side 81*b'*, wherein the axis of connector shaft 85' is parallel to first and second long sides 82*a'* and 82*b'*. Connector shaft 85' is made of a heavy weight material and serves to add to the centralized force of gravitational pull toward the support surface used to stabilize safety binding device 30. Additionally, connector shaft 85' has formed therethrough aperture 86' wherein aperture 86' is perpendicular to the axis of connector shaft 85'.

As can be appreciated, the use of second weight member 80, centrally coupled to bottom surface 53 of stationary crimping bar 50 serves to 1) couple stationary handle member 95 to stationary crimping bar 50 and 2) provide a centralized force of gravitational pull to stabilize my new safety binding device 30.

Pivoting handle member 90 is a tubular member comprising first handle portion 91 and second handle portion 92 wherein first handle portion 91 and second handle portion 92 juncture at apex A1. Second handle portion 92 is sloped such that an obtuse angle is formed between second handle portion 92 and first handle portion 91.

Distal end 93 of first handle portion 91 is slid onto connector shaft 85 for coupling pivoting handle member 90 to first weight member 80. In close proximity to distal end 93, first handle portion 91 has two parallel apertures formed therein which align with aperture 86. In order to secure pivoting handle member 90 to connector shaft 85, locking pin 94 is journalled through such apertures. Although not shown, in close proximity to the end of locking pin 94 there is provided a stop projection which prevents locking pin 94 from slipping out of such apertures. The free end of second handle portion 92 has coupled thereto griping member 93, preferably made of rubber or plastic to allow the operator to firmly grip pivoting handle member 90. In the preferred embodiment, first handle portion 91 and second handle portion 92 are cylindrically shaped tubular members.

Pivoting handle member 90 allows an operator to use his or her weight and/or power for applying a force of pressure for deforming U-shaped clamping means 20. The use of the operators weight provides the necessary force of pressure to securely hold, permanently, loose sheets of paper 10 of stack 11. As shown in FIG. 2, apex A1 stops the rotation of rotatable crimping bar 35 when rotated into the crimping position wherein apex A1 abuts the top surface of stationary handle member 95.

Stationary handle member 95 is a tubular member. Distal end 96 of stationary handle member 95 is slid onto connector shaft 85' for coupling stationary handle member 95 to second weight member 80'. In close proximity to distal end 96, stationary handle member 95 has two parallel apertures formed therein which align with aperture 86'. In order to secure stationary handle member 95 to connector shaft 85', locking pin 98 is journalled through such apertures. Although not shown, in close proximity to the end of locking pin 98 there is provided a stop projection which prevents locking pin 98 from slipping out of such apertures. The free end of stationary handle member 95 has coupled thereto a cover member 99, preferably made of rubber or plastic. In the preferred embodiment, stationary handle member 95 is a rectangularly shaped tubular member. Therefore, the bottom flat surface of stationary handle member 95 is flush with the support surface in which safety binding device 30 is supported and adds to the stabilizing mechanism for stabilizing safety binding device 30. Moreover, the top flat surface of stabilizing safety binding device 30 provides a horizontal support base for stack 11 when U-shaped clamping means 20 having stack 11 inserted therein is being crimped.

The following description will be referring to the operation of my new safety binding device 30. Assuming rotating crimping bar 35 is in it non-crimping position, as best seen in FIG. 3, U-shaped clamping means 20 having stack 11 inserted therein is horizontally slid along ledge 55 until back wall 22 of U-shaped clamping means 20 abuts against first wall 61, as best seen in FIG. 4. While maintaining stack 11 aligned and horizontal, pivoting handle member 90 is rotated in the direction of ARROW 3. Thereafter, the operator applies his or her weight to pivoting handle member 90 unit apex A1 abuts stationary handle member 95. From the foregoing, U-shaped clamping means 20 is crimped such that sheets of paper 10 are securely held together, permanently.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A binding device for crimping or deforming a U-shaped means for clamping around a plurality of sheets of paper comprising:

(a) a stationary crimping bar;

(b) a rotatable crimping bar rotatable coupled above said stationary crimping bar wherein said rotatable crimping bar is rotated between a crimping position and a non-crimping position;

(c) a first weight member fixedly coupled in the center of said rotatable crimping bar; and, (d) a second weight member fixedly coupled in the center of said stationary crimping bar.

2. The binding device of claim 1, wherein said stationary crimping bar has formed therein a channel extending the length thereof wherein said channel is defined by a first wall having a first height and a second wall having a second height; wherein said first height of said first wall provides a stop means for stopping the back surface of said U-shaped clamping means; and wherein said second wall further has a width wherein said width provides a support ledge for a bottom surface of said U-shaped clamping means.

3. The binding device of claim 1, wherein said rotatable crimping bar comprises a rectangular projection projecting from a bottom surface of said rotatable crimping bar, said rectangular projection serves to provide a continuous surface for evenly deforming a first side of said U-shaped clamping means as a force of pressure is applied to force said rotatable crimping bar into said crimping position and serves to provide a continuous surface for facilitating the deformation of a second side of said U-shaped clamping means.

4. The binding device of claim 1, further comprises:

a pivoting handle member removably coupled to said rotatable crimping bar wherein said pivoting handle member moves said rotatable crimping bar between said crimping position and said non-crimping position, easily and effortlessly; and, a stationary handle member removable coupled to said stationary crimping bar.

5. The binding device of claim 4, wherein said first weight serves to 1) couple said pivoting handle member to said rotatable crimping bar, 2) provide a centralized force of gravitational pull to urge said rotatable crimping bar toward said crimping position or said non-crimping position; and, 3) stop the rotation of said rotatable crimping bar when said rotatable crimping bar is rotated into said non-crimping position.

6. The binding device of claim 4, wherein said second weight member serves to 1) couple said stationary handle member to said stationary crimping bar and 2) provide a centralized force of gravitational pull for stability.

7. The binding device of claim 1, further comprises first and second parallel support brackets coupled to each distal end of said rotatable crimping bar and said stationary crimping bar for rotatably supporting said rotatable crimping bar above said stationary crimping bar.

8. A binding device for crimping or deforming a U-shaped means for clamping around a plurality of sheets of paper comprising:

(a) a stationary crimping bar;

(b) a rotatable crimping bar rotatable coupled above said stationary crimping bar wherein said rotatable crimping bar is rotated between a crimping position and a non-crimping position;

(c) a first weight member fixedly coupled in the center of said rotatable crimping bar;

(d) a second weight member fixedly coupled in the center of said stationary crimping bar;

(e) a pivoting handle member removably coupled to said rotatable crimping bar wherein said pivoting handle member moves said rotatable crimping bar between said crimping position and said non-crimping position, easily and effortlessly; and, (f) a stationary handle member removable coupled to said stationary crimping bar.

9. The binding device of claim 8, wherein said stationary crimping bar has formed therein a channel extending the length thereof wherein said channel is defined by a first wall having a first height and a second wall having a second height; wherein said first height of said first wall provides a stop means for stopping the back surface of said U-shaped clamping means; and wherein said second wall further has a width wherein said width provides a support ledge for a bottom surface of said U-shaped clamping means.

10. The binding device of claim 8, wherein said rotatable crimping bar comprises a rectangular projection projecting from a bottom surface of said rotatable crimping bar, said rectangular projection serves to provide a continuous surface for evenly deforming a first side of said U-shaped clamping means as a force of pressure is applied to force said rotatable crimping bar into said crimping position and serves to provide a continuous surface for facilitating the deformation of a second side of said U-shaped clamping means.

11. The binding device of claim 8, wherein said first weight serves to 1) couple said pivoting handle member to said rotatable crimping bar, 2) provide a centralized force of gravitational pull to urge said rotatable crimping bar toward said crimping position or said non-crimping position; and, 3) stop the rotation of said rotatable crimping bar when said rotatable crimping bar is rotated into said non-crimping position.

12. The binding device of claim 8, wherein said second weight member, centrally coupled to a top surface of said stationary crimping bar serves to 1) couple said stationary handle member to said stationary crimping bar and 2) provide a centralized force of gravitational pull for stability.

13. The binding device of claim 8, further comprises first and second parallel support brackets coupled to each distal end of said rotatable crimping bar and said stationary crimping bar for supporting rotatably supporting said rotatable crimping bar above said stationary crimping bar.

14. A binding device for crimping or deforming a U-shaped means for clamping comprising:

(a) a stationary crimping bar;

(b) a rotatable crimping bar rotatable coupled above said stationary crimping bar wherein said rotatable crimping bar is rotated between a crimping position and a non-crimping position;

(c) a first weight member fixedly coupled in the center of said rotatable crimping bar wherein said first weight serves to provided a centralized force of gravitational pull to urge said rotatable crimping bar toward said crimping position; and, (d) a second weight member fixedly coupled in the center of said stationary crimping bar wherein said second weight member provides a centralized force of gravitational pull for stability.

15. The binding device of claim 14, wherein said stationary crimping bar has formed therein a channel extending the length thereof wherein said channel is defined by a first wall having a first height and a second wall having a second height; wherein said first height of said first wall provides a stop means for stopping the back surface of said U-shaped clamping means; and wherein said second wall further has a width wherein said width provides a support ledge for a bottom surface of said U-shaped clamping means.

16. The binding device of claim 14, wherein said rotatable crimping bar comprises a rectangular projection projecting from a bottom surface of said rotatable crimping bar, said rectangular projection serves to provide a continuous surface for evenly deforming a first side of said U-shaped clamping means as a force of pressure is applied to force said rotatable crimping bar into said crimping position and serves to provide a continuous surface for facilitating the deformation of a second side of said U-shaped clamping means.

17. The binding device of claim 14, further comprising:

a pivoting handle member removably coupled to said rotatable crimping bar wherein said pivoting handle member moves said rotatable crimping bar between said crimping position and said non-crimping position, easily and effortlessly; and, p1 a stationary handle member removable coupled to said stationary crimping bar.

18. The binding device of claim 17, wherein said first weight further serves to 1) couple said pivoting handle member to said rotatable crimping bar and 2) stop the rotation of said rotatable crimping bar when said rotatable crimping bar is rotated into said non-crimping position.

19. The binding device of claim 17, wherein said second weight member further serves to couple said stationary handle member to said stationary crimping bar.

20. The binding device of claim 14, further comprises first and second parallel support brackets coupled to each distal end of said rotatable crimping bar and said stationary crimping bar for supporting rotatably supporting said rotatable crimping bar above said stationary crimping bar.

* * * * *